US007553262B2

(12) United States Patent
Piane, Jr.

(10) Patent No.: US 7,553,262 B2
(45) Date of Patent: Jun. 30, 2009

(54) EXERCISE APPARATUS USING WEIGHTS AND SPRINGS FOR HIGH-SPEED TRAINING

(75) Inventor: Robert A. Piane, Jr., Newark, DE (US)

(73) Assignee: BVP Holding, Inc., Newark, DE (US)

( * ) Notice: Subject to any disclaimer, the term of this patent is extended or adjusted under 35 U.S.C. 154(b) by 826 days.

(21) Appl. No.: 10/987,376

(22) Filed: Nov. 12, 2004

(65) Prior Publication Data

US 2006/0105888 A1 May 18, 2006

(51) Int. Cl.
*A63B 21/06* (2006.01)

(52) U.S. Cl. ..... 482/99; 482/102; 482/103

(58) Field of Classification Search ..... 482/98–104, 482/20, 17, 909, 142, 130
See application file for complete search history.

(56) References Cited

U.S. PATENT DOCUMENTS 3,640,529 A * 2/1972 Kane ..... 482/129
4,198,045 A 4/1980 Miller
4,272,074 A 6/1981 Sferle
4,357,010 A 11/1982 Telle
4,358,107 A 11/1982 Nissen
4,511,137 A 4/1985 Jones
4,564,194 A 1/1986 Dawson
4,592,545 A 6/1986 Sagedahl et al.
4,601,466 A * 7/1986 Lais ..... 482/98
4,645,197 A * 2/1987 McFee ..... 482/31
4,657,246 A * 4/1987 Salyer ..... 482/94
4,691,916 A * 9/1987 Voris ..... 482/98
4,733,859 A 3/1988 Kock et al.
4,822,037 A 4/1989 Makansi et al.
4,919,418 A 4/1990 Miller
4,981,294 A 1/1991 Dalebout et al.
4,988,095 A 1/1991 Ferrari
5,015,926 A 5/1991 Casler
5,016,871 A 5/1991 Dalebout et al.
5,029,849 A 7/1991 Nurkowski
5,050,872 A 9/1991 Farenholtz
5,117,170 A 5/1992 Keane et al.
5,163,888 A 11/1992 Stearns
5,209,461 A 5/1993 Whightsil, Sr.
5,211,613 A 5/1993 Friesl
5,213,556 A 5/1993 Boren
5,311,827 A 5/1994 Greene
5,346,448 A 9/1994 Sollo (Continued)

*Primary Examiner*—Jerome Donnelly
(74) *Attorney, Agent, or Firm*—Milde & Hoffberg, LLP

(57) ABSTRACT

Exercise equipment of the type comprising a frame structure; a handle coupled to the frame structure and adapted for movement by a user, back and forth in a first direction and in an opposite second direction; and at least one weight, coupled to the handle for applying a gravitational force to the handle in the second direction. According to the invention, a spring device, having two ends, is coupled to the handle at one end and to the frame structure at the opposite end to apply a spring force to the handle in the second direction. With proper choice of the spring constant of the spring device, when the handle is rapidly moved by the user in the first direction and then suddenly moved in the second direction, the total force applied to the handle in the second direction is maintained above minimum threshold value which is sufficient for "high-speed training".

28 Claims, 13 Drawing Sheets

U.S. PATENT DOCUMENTS

| | | | |
|---|---|---|---|
| 5,387,170 | A | 2/1995 | Rawls et al. |
| 5,387,171 | A | 2/1995 | Casey et al. |
| 5,400,721 | A | 3/1995 | Greene |
| 5,433,678 | A | 7/1995 | Chi |
| 5,512,029 | A | 4/1996 | Barnard et al. |
| 5,583,403 | A | 12/1996 | Anjanappa et al. |
| 5,643,146 | A | 7/1997 | Stark et al. |
| 5,643,153 | A | 7/1997 | Nylen et al. |
| 5,653,667 | A | 8/1997 | Reyes |
| 5,738,611 | A | 4/1998 | Ehrenfried et al. |
| 5,836,859 | A | 11/1998 | Van Herle |
| 5,891,004 | A | 4/1999 | Berry |
| 5,897,470 | A | 4/1999 | Chen |
| 5,938,574 | A | 8/1999 | Webber |
| 5,971,897 | A | 10/1999 | Olson et al. |
| 6,066,074 | A | 5/2000 | Marcinkiewicz |
| 6,165,110 | A | 12/2000 | Gajda |
| 6,312,365 | B1 | 11/2001 | Koenig |
| 6,458,060 | B1 | 10/2002 | Watterson et al. |
| 6,561,956 | B1 | 5/2003 | Allison |
| 6,669,609 | B2 | 12/2003 | Gerschefske et al. |
| 6,705,976 | B1 | 3/2004 | Piane, Jr. |
| 7,192,389 | B2 | 3/2007 | Allison |
| 2001/0034290 | A1 | 10/2001 | Tolles |
| 2002/0016237 | A1 | 2/2002 | Schmidt |
| 2002/0025891 | A1 | 2/2002 | Colosky, Jr. et al. |
| 2002/0077229 | A1 | 6/2002 | McBride |
| 2002/0088910 | A1 | 7/2002 | Sweere et al. |
| 2002/0103058 | A1 | 8/2002 | Webber |
| 2002/0142893 | A1 | 10/2002 | Koenig |
| 2003/0096681 | A1 | 5/2003 | Myers et al. |
| 2004/0058786 | A1 | 3/2004 | Nerio et al. |
| 2005/0101451 | A1* | 5/2005 | Ooka ..... 482/99 |
| 2006/0063649 | A1 | 3/2006 | Allison |

* cited by examiner

EXERCISE APPARATUS USING WEIGHTS AND SPRINGS FOR HIGH-SPEED TRAINING

CROSS REFERENCE TO RELATED APPLICATION

This present application claims benefit of priority from U.S. patent application Ser. No. 09/678,931, filed Oct. 4, 2000, entitled "EXERCISE APPARATUS", now U.S. Pat. No. 6,705,976; U.S. patent application Ser. No. 09/965,032, filed Sep. 27, 2001, entitled "WEIGHT SYSTEMS FOR EXERCISE EQUIPMENT"; and U.S. patent application Ser. No. 10/736,807, filed Dec. 15, 2003, entitled "EXERCISE APPARATUS USING WEIGHTS FOR HIGH-SPEED TRAINING".

BACKGROUND OF THE INVENTION

The present invention relates to exercise equipment of the type which utilizes one or more weights to apply a force to a movable handle.

Various types of exercise equipment are known wherein one or more weights are used to exert a gravitational force against a handle or the like which is moved by a user. For example, in one type of device, the handle is attached to one end of a pivot arm that allows the handle to be moved up or down by a user. A weight is either attached to the pivot arm between the pivot point and the handle, in which case the handle is forced downward by the gravitational force of the weight, or attached to the pivot arm on the opposite side of the pivot point, in which case the handle is forced upward as the weight is drawn downward by the gravitational force.

In another type of exercise equipment, the handle is attached to one end of a cable, called the proximal end, which may be pulled or released by a user. In this case, the weight is coupled to an opposite, distal end of the cable to apply a tensile force to the cable as it is pulled and released with the handle.

Equipment of this type operates extremely well to develop arm and/or leg muscles when the handle is pulled or pressed relatively slowly, thus moving the handle back and forth, in its two opposite directions of movement, in such a manner that the gravitational force applied to the handle remains substantially constant. However, such equipment does not maintain this constant gravitational force when the handle is moved rapidly back and forth by the user—an exercise known as "high-speed training". In this case, the momentum developed by the weight during the high-speed movement creates an uncontrollable and sometimes dangerous variation in the force applied to the handle. In the case of machines with a pivoted traveling arm, the variation in gravitational force may be so great, as the arm switches directions, that it can be harmful to the user as he or she braces to try and hold on to the handle. Similarly, with machines which employ a cable connected to a weight, the weight can be caused to fly up along the guide rods, causing the tension in the cable to fall to zero, and then "bounce back" with a sudden jerk of the cable and a consequent spike in the cable tension, as the weight falls back down again and the cable brakes its descent.

Ideally, the force applied to the handle of exercise equipment should remain approximately constant, independent of the speed with which the handle is moved by the user. However, with high-speed training movements, the force due to weights varies considerably.

Exercise equipment is also known which does not use a weight or weights to apply a gravitational force to a user handle. Such equipment uses a set of elastic bands, springs, torsion bars or the like which apply a spring force to the handle. With such equipment, the static force applied to the handle is substantially the same as the dynamic force applied when the handle is moved, either slowly or rapidly. As compared to an exercise machine which employs a weight to apply a gravitational force to the handle, such machines have a disadvantage that the spring force increases linearly as the handle is moved from its rest position to an extended position. When the spring constant is relatively high, to provide a substantial spring force in the mid-range of movement of the handle, this force becomes extremely high as the handle is moved toward the end of its travel, just in a position where the user's arms or legs are extended and, consequently, their strength becomes weaker.

The U.S. Pat. No. 6,561,956 discloses a "dynamic active resistance training system" which comprises exercise apparatus of the type that incorporates a weight stack, with a selectable number of weights, which is lifted by a user by means of a cable. The proximal end of the cable is provided with a handle to be held and pulled by the user. The distal (opposite) end of the cable is attached to the weight stack. In addition to the weight stack, one or more "resiliently stretchable" cords are connected in parallel on one side of the weight stack, between the top most weight and the bottom of the frame of the exercise apparatus, to exert additional tension on the cable due to the spring force. While the arrangement disclosed in this patent is partially effective for the purpose for which it is intended, the application of force to one side of the weight stack causes the stack to become unbalanced, resulting in excessive friction and binding against the guide rails that provide lateral support to the movable weights. This increased friction impairs the operation of the exercise equipment especially when it is to be used in "high-speed training" where the handle is rapidly moved back and forth by the user.

SUMMARY OF THE INVENTION

It is a principal object of the present invention to provide exercise equipment of the type which utilizes one or more weights that exert a gravitational force on a handle, which equipment may be used in "high-speed training" where the handle is rapidly moved back and forth by a user.

It is a further object of the present invention to provide exercise equipment of the type described above which uses one or more weights as well as one or more springs (e.g., resilient cords) connected in parallel.

It is a further object of the present invention to provide exercise equipment of the type described above which may be used in high-speed training and in which frictional forces of moving parts are kept to a minimum.

These objects, as well as other objects which will become apparent from the discussion that follows, are achieved, in accordance with the present invention, by providing an exercise equipment of the type comprising a frame structure; a handle coupled to the frame structure and adapted for movement by a user, back and forth in a first direction and in an opposite second direction; and at least one weight, coupled to the handle for applying a gravitational force to the handle in the second direction. According to the invention, an elongate spring device, having two ends, is coupled to the handle at one end and to the frame structure at the opposite end to apply a spring force to the handle in the second direction. With proper choice of the spring constant of the spring device, in relation to the gravitational force applied by the weight(s), when the handle is rapidly moved by the user in the first direction and then suddenly moved in the second direction, the total force applied to the handle in the second direction is maintained above a minimum threshold value.

As a consequence, the exercise equipment according to the present invention takes advantage of the substantially constant force applied to the user handle by the weight, while also taking advantage of the linearly increasing force applied to the handle which is possible with equipment which generates a spring force. The total force applied to the handle is thus a combination of the gravitational force due to the weight or weights and the spring force applied by the spring device. In view of the presence of the gravitational force, the spring force can be substantially less than that required for exercise machines which utilize only a spring type force to provide resistance to the handle. The relative percentage of the gravitational force and spring force used in the exercise equipment may be adjusted, as desired, depending upon the intended use of the equipment. For relatively slow movements of the handle, the force applied should preferably be primarily the gravitational force applied by the weight or weights. For rapid movement, as in high-speed training, the percentage of spring force may be increased, and the percentage of gravitational force correspondingly decreased, so that the total force applied to the handle remains substantially constant during the rapid movements.

Accordingly, both the amount of gravitational force and the amount of spring force should be made variable so that the user can select the forces that are most appropriate to his or her use of the exercise equipment.

In accordance with a preferred embodiment of the present invention, the weights which are used in the exercise equipment are in the form of a "weight stack" having means for selecting the number of weights to be lifted by the user. In this embodiment, the weight stack is supported against lateral movement by guide rails or rods which pass vertically through the set of weights. According to one embodiment, the spring device is made up of one or more tension springs (e.g., resilient cords, such as elastic straps) which are connected between the top most weight and the bottom frame of the exercise equipment. In order to balance the lateral forces applied to the weight stack by the spring device which provides this tensive force, the spring device is attached to both (opposite) sides of the weight stack.

Alternatively, the spring device may be attached to only one side of the weight stack provided that the top most weight, to which the spring device is attached, is retained in a lateral position by means of rollers, linear bearings or the equivalent, which slide along the guide rails or rods with a minimum of friction.

In another embodiment of the invention, the spring device may comprise one or more compression springs which are connected between the top most weight and the top frame of the exercise apparatus. In this case, the springs may be applied to press against the top most weight with a balanced force, to avoid causing undue friction between the weight and its guide rails or rods.

In still another embodiment of the present invention, unbalance of the top most weight may be avoided entirely by connecting the spring device, which may provide either a tensive or compressive force, directly to the cable, the moving arm and/or handle of the exercise apparatus.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
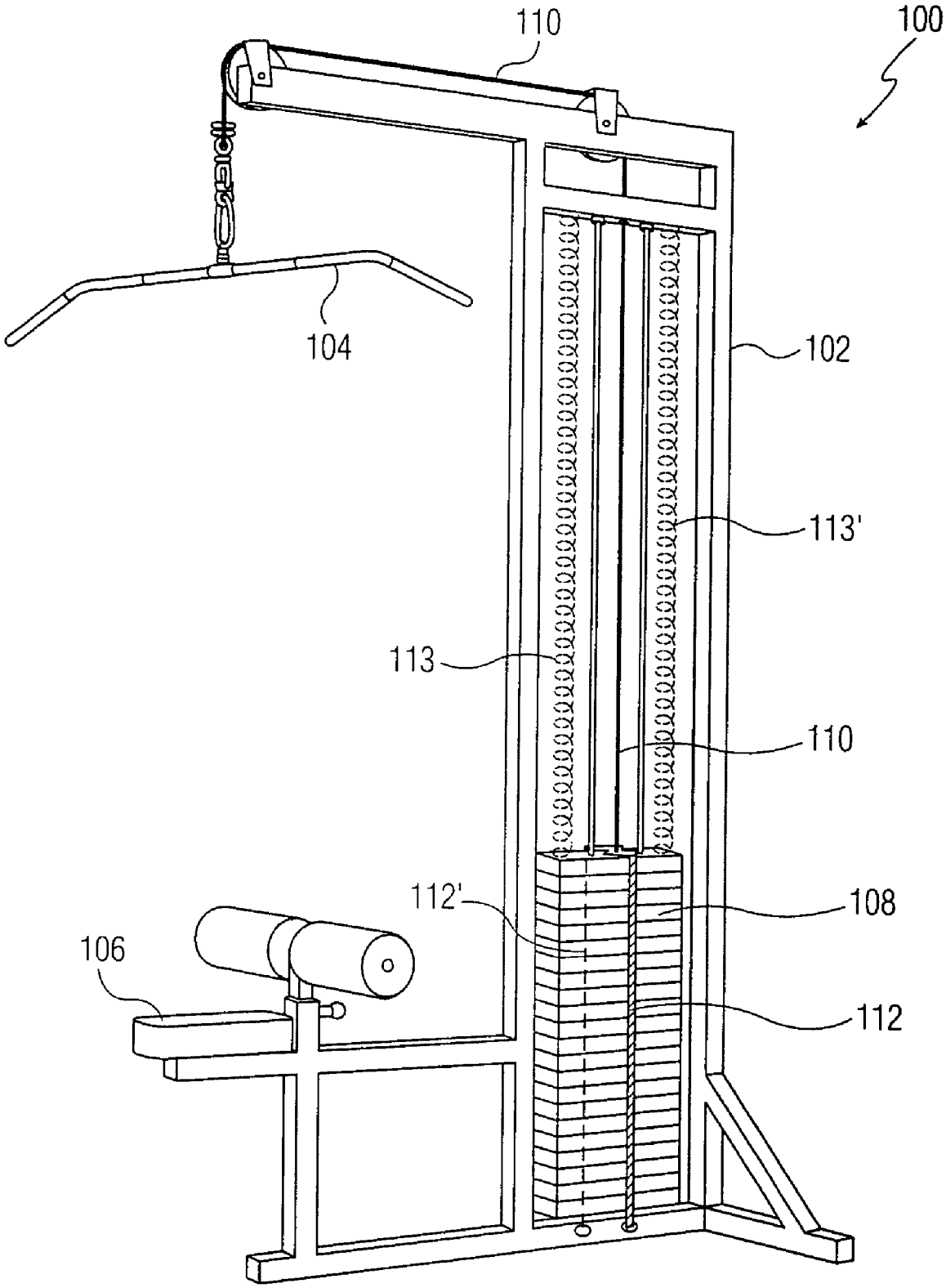
FIG. 1 is a perspective view of exemplary exercise equipment of the type which has a handle connected to one end of a cable and a stack of weights as well as a spring device coupled to an opposite or distal end of the cable.

The preferred embodiments of the present invention will now be described with reference to FIGS. 1-15 of the drawings. Identical elements in the various figures are designated with the same reference numerals.

FIG. 1 shows an exercise machine 100 having a frame structure 102; a handle 104 adapted to be gripped by a user, who may either stand or be seated on a seat 106; and a cable 110 which couples the handle to a stack of weights 108. The number of weights in the stack 108 may be selected by the user to vary the gravitational force applied to the cable 110 and, thus, to the handle 104. As the handle 104 is pulled slowly by a user, one or more of the weights 108 at the top of the stack are lifted and thus supply substantially constant tension to the cable 110.

According to the invention, a spring device 112, which may be an elastic (e.g., rubber) band, a coil spring, bungee cord or the like, is connected between the top of the weight stack 108 and the frame 102 of the weight stack 108, to apply a spring force to the cable 110. As shown in FIG. 1 in dashed lines, a second spring 112' device is also connected between the top of the weight stack 108 and the frame 102 on the opposite side of the stack in order to balance the lateral forces applied to the stack. Further, the spring devices 112 and 112' on both sides of the weight stack are preferably made removable so that the user can remove and replace the spring devices as desired, so that spring devices of various spring constants may be used. In addition, it is possible to use multiple spring devices, preferably on both sides of the weight stack, so that the spring constant may be matched to the needs of the user for "high-speed training".

Instead of providing a tension spring device 112 and 112', it is possible alternatively to provide compression spring devices 113 and 113', preferably on both sides of the cable 110, as shown in dashed lines in FIG. 1. These compression spring devices serve the same function as the tension spring devices 112 and 112'.

The compression spring devices may be realized, for example, as a coil spring or as a pneumatic spring which produces a spring force by the compression of air.

As is well known, a spring force is approximately linearly dependent upon the distance the spring is extended.

That is:

$$F_s = Kx,$$

where $F_s$ is the spring force, K is the spring constant and x is the distance the spring is extended from its relaxed ($F_s$=0) state.

Figure 2A:
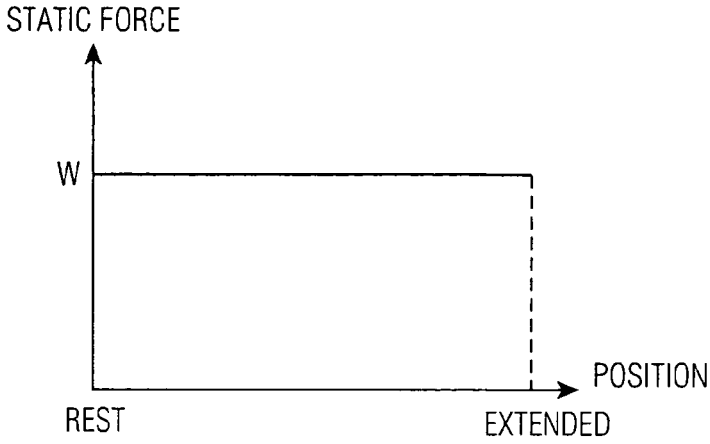
FIG. 2A is a diagram showing the static force applied to the handle in the exercise equipment of FIG. 1, relative to the position of the handle, when only weights are used to apply a force to the handle.

If the exercise machine were operated without the spring devices 112 and 112', such that only the weights 108 were used to apply a gravitation force to the cable 110, the static force W on the handle 104 would be independent of the position of the handle as shown in FIG. 2A.

Figure 2B:
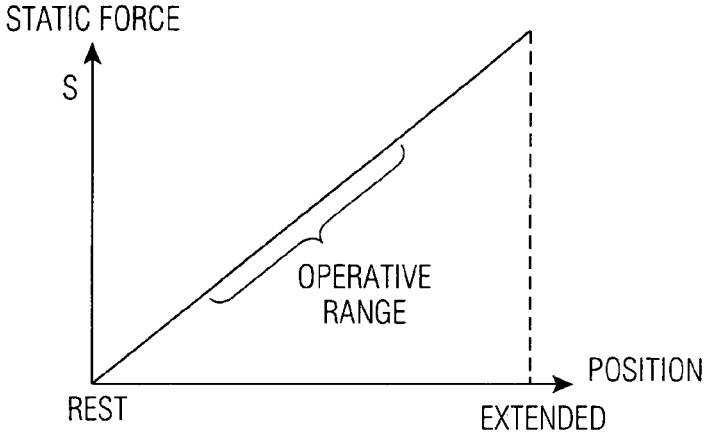
FIG. 2B is a diagram showing the static force applied to the handle in the exercise equipment of FIG. 1, relative to the position of the handle, when only the spring device is used to apply a force to the handle.

On the other hand, if only the spring devices 112 and 112', and not the weight stack 108, were coupled to the end of the cable 110, the static force S applied to the handle 104 would be the linearly increasing spring force as shown in FIG. 2B.

Figure 2C:
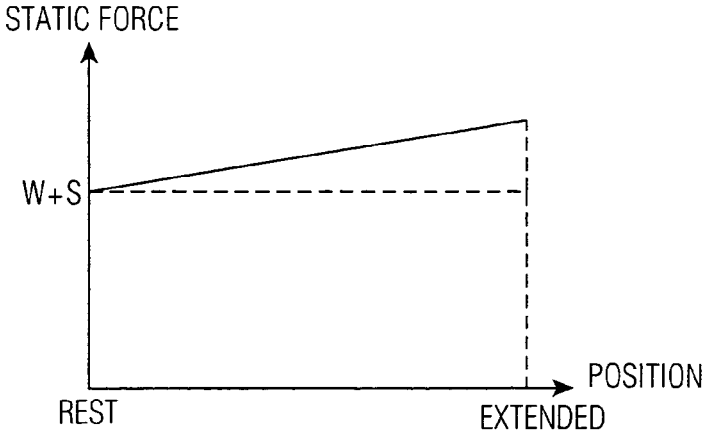
FIG. 2C is a diagram showing the static force applied to the handle in the exercise equipment of FIG. 1, relative to the position of the handle, when both the weights and the spring device are used to apply forces to the handle.

When both the weight stack 108 and the spring devices 112 and 112' are coupled to the cable 110, the static force applied to the handle 104 is a combination of a constant force W and a linearly varying force S as shown in FIG. 2C.

Figure 3A:
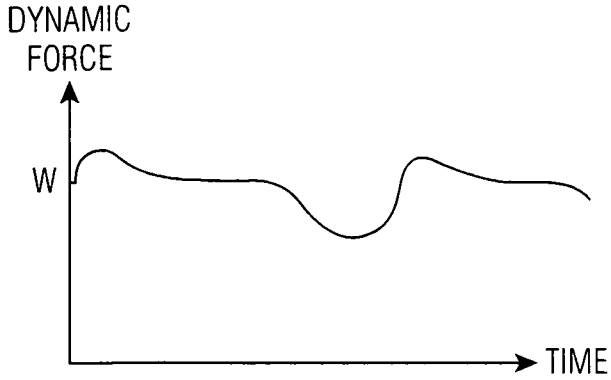
FIGS. 3A and 3B are diagrams showing the dynamic force applied to the handle, in the exercise equipment of FIG. 1, as the handle is moved slowly (FIG. 3A) and rapidly (FIG. 3B) over time, when only weights are used to apply a force to the handle.

During normal training, when the handle 104 is moved back and forth (or up and down) relatively slowly by the user, the dynamic force applied to the handle is not significantly different from the static force. FIG. 3A is a diagram showing (somewhat exaggerated) the dynamic force attributable to only the selected weights in the weight stack 108 during a normal training cycle. Initially, when the handle is pulled, the weights must be accelerated from a dead stop, so that the dynamic force increases slightly. Thereafter, as the weights are drawn upward at a constant speed, the dynamic force remains constant and equal to W. Following that, when the direction of movement of the handle is reversed, the weights decelerate and then start moving downward in the frame structure. When this occurs, the dynamic force is reduced slightly as the weights descend to their rest position.

Figure 3B:
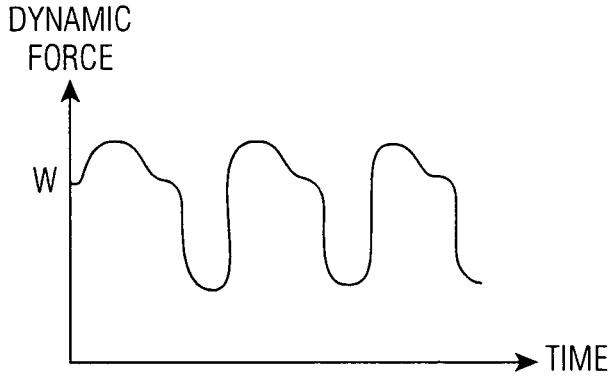

When an exercise machine, which utilizes only one or more weights to apply a gravitational force to the handle, is used for high-speed training, whereby the handle is moved rapidly by the user in a first direction and then quickly moved in a second, opposite direction, the dynamic force will vary markedly and uncontrollably. Such marked variations are illustrated in FIG. 3B. In this case, the weight stack is initially accelerated rapidly upward, causing a rapid rise in the force applied to the handle. Thereafter, when the direction of movement of the handle is reversed, the weight or weights can be in substantially "free fall", depending upon the speed with which the direction of motion is reversed. Finally, when the handle is again moved in the first direction, the direction of movement of the weights is suddenly changed from downward to upward, resulting in a spike in the dynamic force applied to the handle.

Figure 3C:
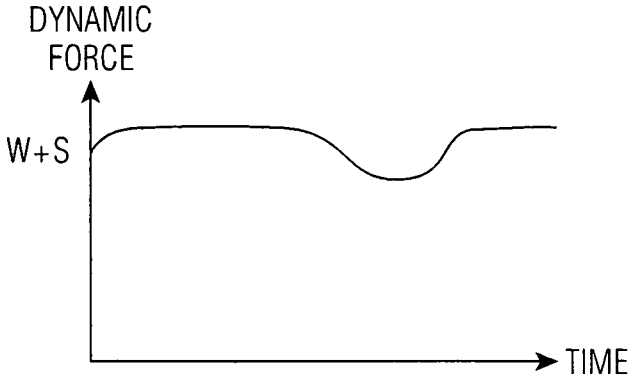
FIGS. 3C and 3D are diagrams showing the dynamic force applied to the handle, in the exercise equipment of FIG. 1, as the handle is moved slowly (FIG. 3C) and rapidly (FIG. 3D) over time, when both weights and the spring device are used to apply a force to the handle.
Figure 3D:
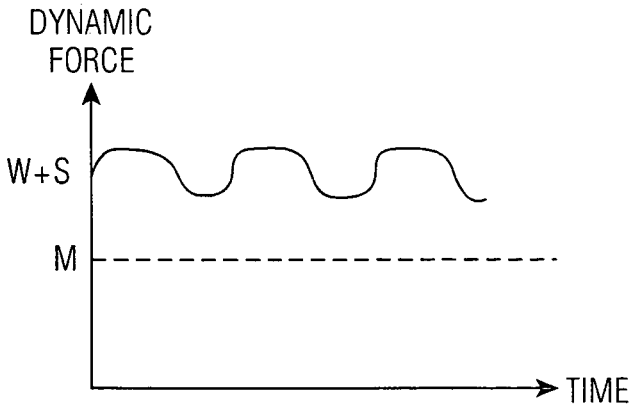

FIGS. 3C and 3D illustrate how the force applied to the handle, in the exercise machine of FIG. 1, may be controlled, even during use in high-speed training, by coupling the spring device between the handle and the frame structure. As shown in FIG. 3C, the dynamic force applied to the handle, even during normal training, is smoothed slightly as compared to the dynamic force without the spring device (FIG. 3A). In FIG. 3D, it may be seen that the total dynamic force applied to the handle remains above a minimum threshold value M, notwithstanding the rapid back and forth movements of the handle. The dynamic force in FIG. 3D is thus a substantial improvement, in terms of user comfort, as compared to the dynamic force of FIG. 3B.

Figure 4:
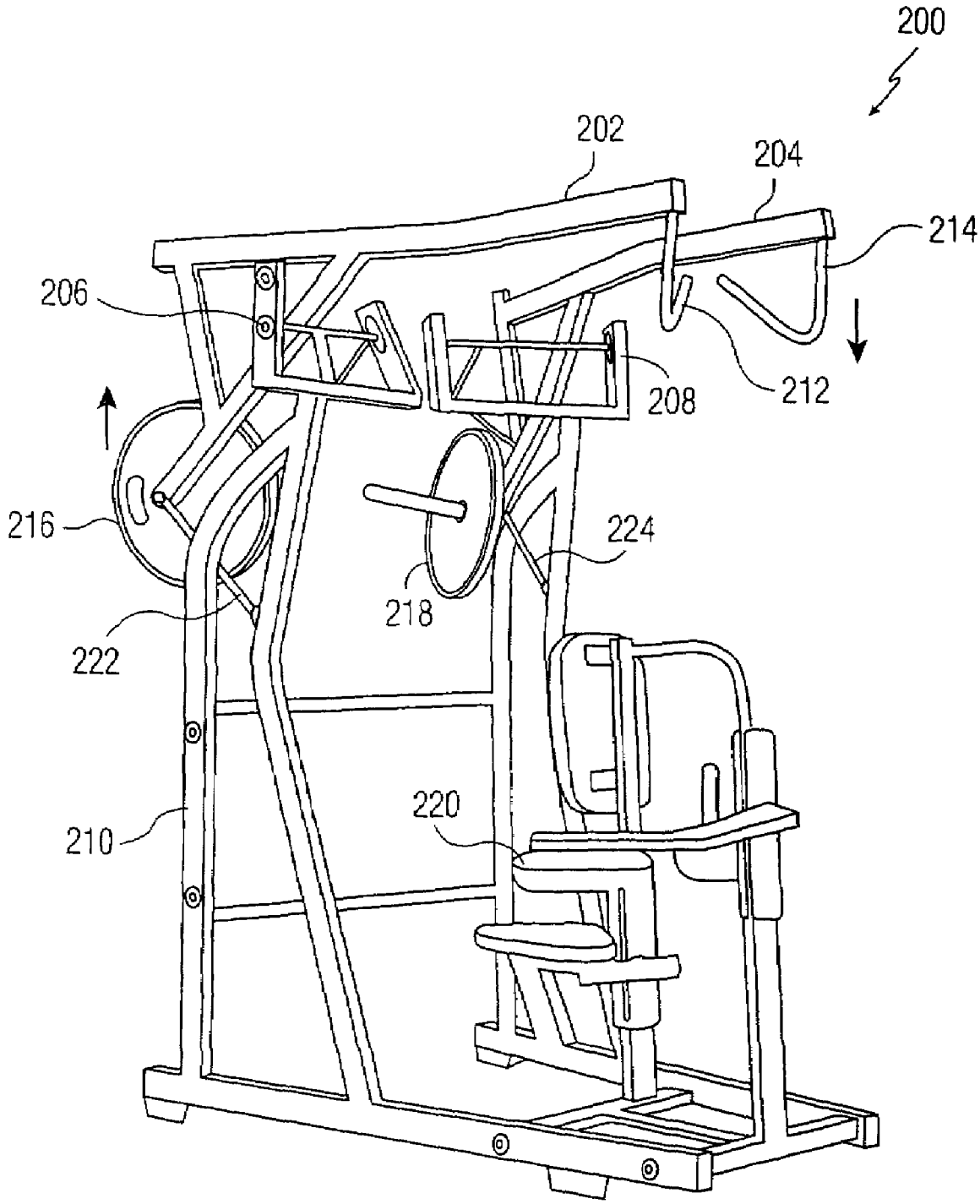
FIG. 4 is a perspective view of exercise equipment with a handle attached to one end of a pivoting arm and with both a weight and a spring device attached to the arm on the opposite side of the pivot point to apply both a gravitational force and spring force thereto.
Figure 5:
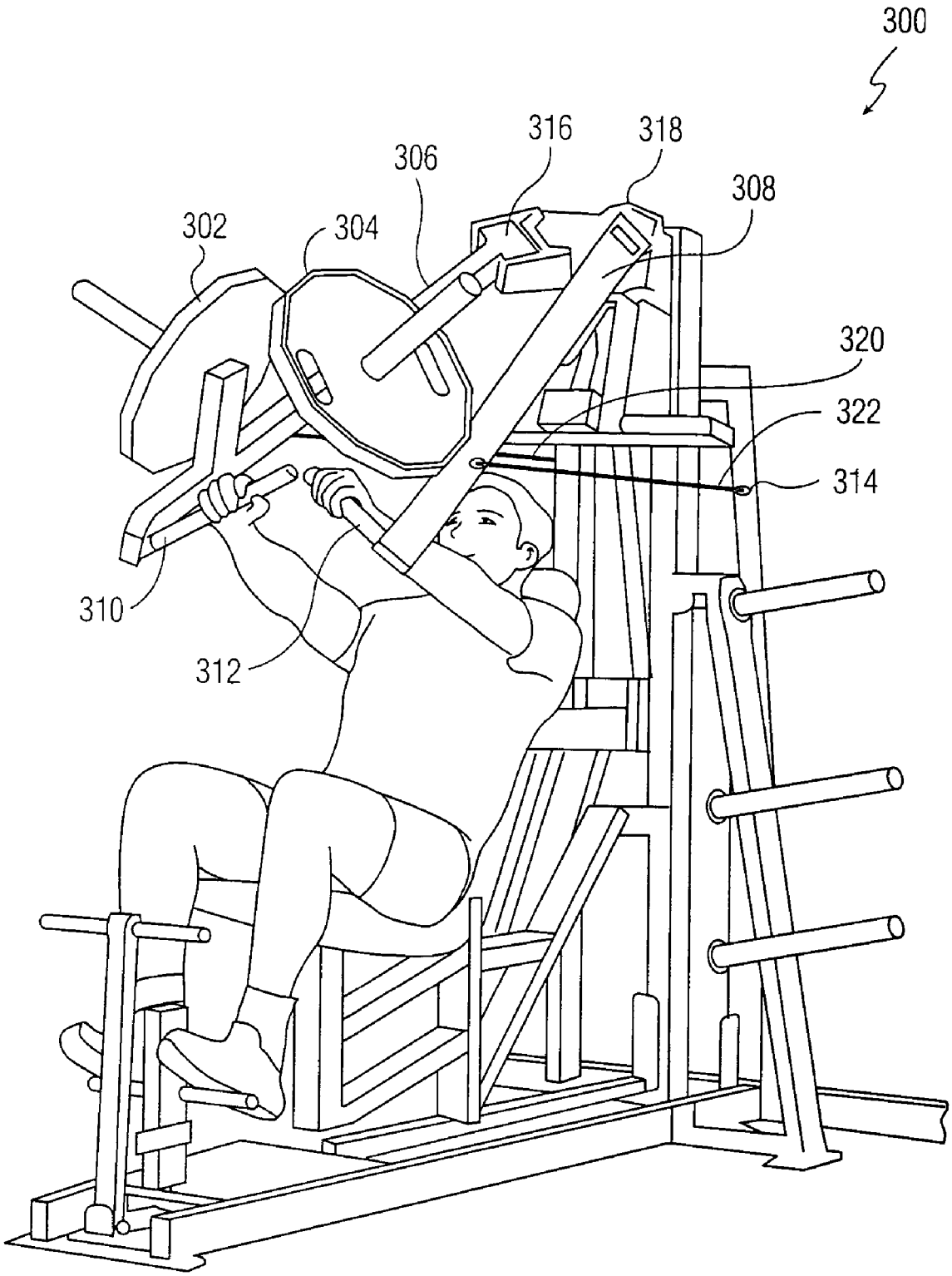
FIG. 5 is a perspective view of exercise equipment with a handle attached to one end of a pivoting arm and with both a weight and a spring device attached to the arm between the handle and the pivot point.

FIGS. 4 and 5 illustrate exercise machines 200 and 300, respectively, which employ pivoted traveling arms, instead of a cable, to connect the weights and the handles. In FIG. 4, the traveling arms 202 and 204 are pivoted at 206 and 208, respectively, on the frame structure 210. Handles 212 and 214 are attached to one end of the arms 202 and 204, respectively, while weights 216 and 218 are attached to the opposite ends. The user, who may sit in a seat 220, grabs one handle with each arm and pulls it downward against the gravitational force of the respective weight.

According to the invention, spring devices 222 and 224 are connected between the weighted end of the pivot arm 202 and 204, respectively, and the frame structure 210, to add spring forces to the gravitational forces applied by the weights.

FIG. 5 shows an exercise machine 300 in which weights 302 and 304 are attached to pivoted traveling arms 306 and 308, respectively, near the ends of the arms which bear the handles 310 and 312. The opposite ends of the arms 306 and 308 are connected with the frame structure 314 through pivots 316 and 318, respectively.

According to the invention, a spring device 320 and 322 is connected between the pivot arm 306 and 308, respectively, and the frame structure 314. Like the weights 302 and 306, these spring devices are preferably made removable so that the user can remove and replace the spring devices as desired, and/or can apply multiple spring devices to each pivot arm.

FIGS. 6-12 illustrate the preferred embodiment and best mode for practicing the invention. These figures illustrate the invention as applied to exercise equipment 10 having multiple cables, each with a handle, coupled to a common weight stack.

Figure 6:
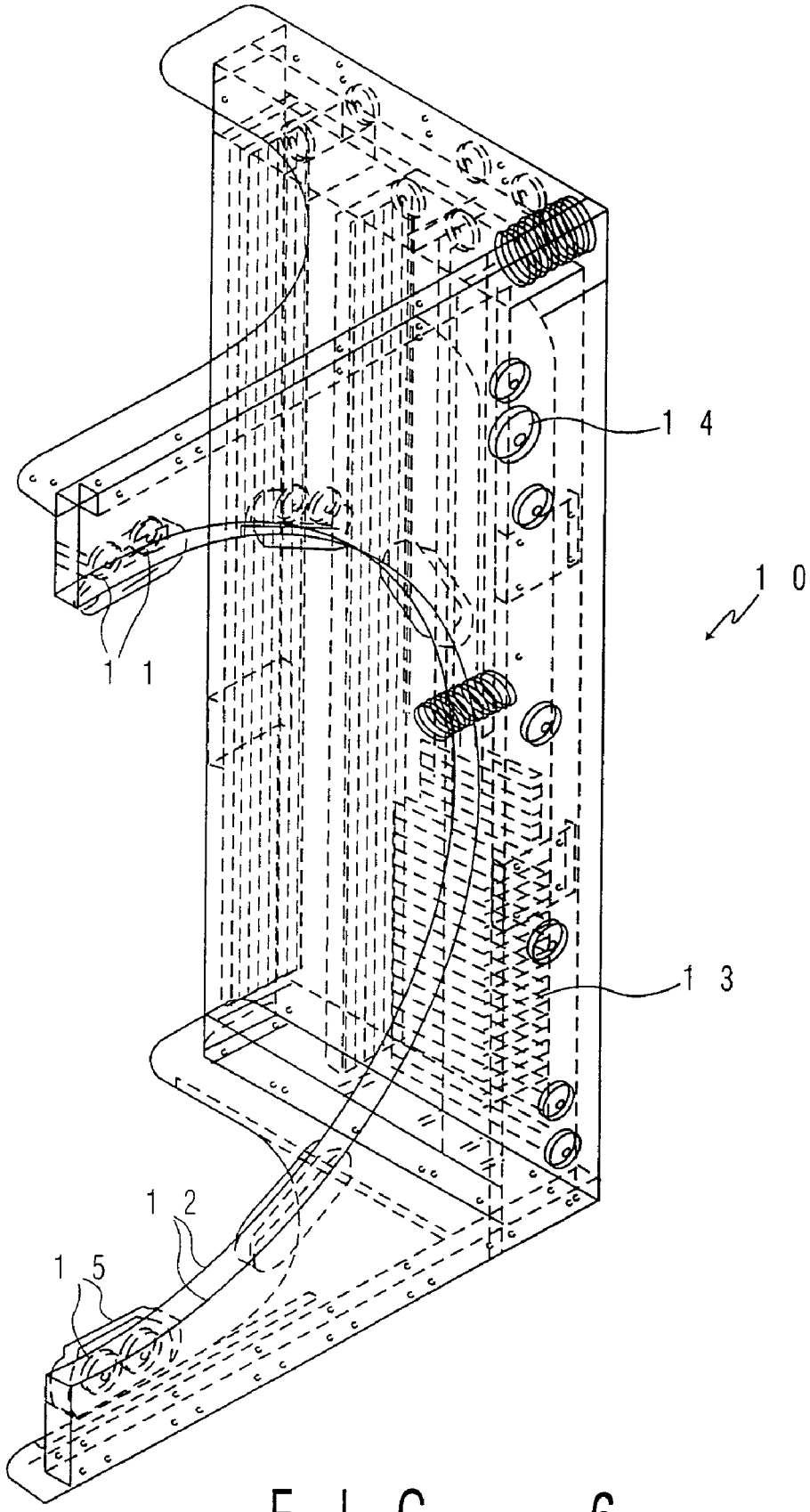
FIG. 6 is a perspective phantom view of exercise equipment according to the preferred embodiment of the present invention.

FIG. 6 is a phantom perspective view of this exercise equipment 10 which has seven pairs of pulleys, one pair of which is identified as 11, placed in the arcuate slot formed by the two side frames 12. Each pair is spaced 30° away from its neighbor(s), as may be better seen in FIG. 7. A greater or smaller number of pairs of pulleys could be used. A weight stack 13 is comprised of a number of small weights that can be used in combination. Cables 9 (FIG. 7) extend through a series of rollers 15, pairs of pulleys 11 and multiple pulleys 14. The proximal end 101 of each of the cables 9, outside rollers 15, is attached to a handle 100, 102 or 103 that enables a user to exert force against the weights. The distal ends of the cables 9 are threaded between rollers 15 and pulleys 11 and then through a series of pulleys, one of which is identified as 14.

In this embodiment, seven cables 9 are strung from the proximal end external to the equipment 10 through pairs of pulleys 11 from which they exit in generally horizontal position to the right where they pass over redirection pulleys 14 to change direction to vertically upward. The pulleys 14 server to redirect the cables 9 from a generally horizontal incoming direction to vertical upward direction.

Pulleys 14.1, of which there are seven aligned vertically, serve to redirect the distal ends of the cables 9 from a generally vertical upward direction to a substantially horizontal direction to seven aligned pulleys 14.2 and serve to redirect cables 9 to a substantially vertical downward direction.

Figure 8:
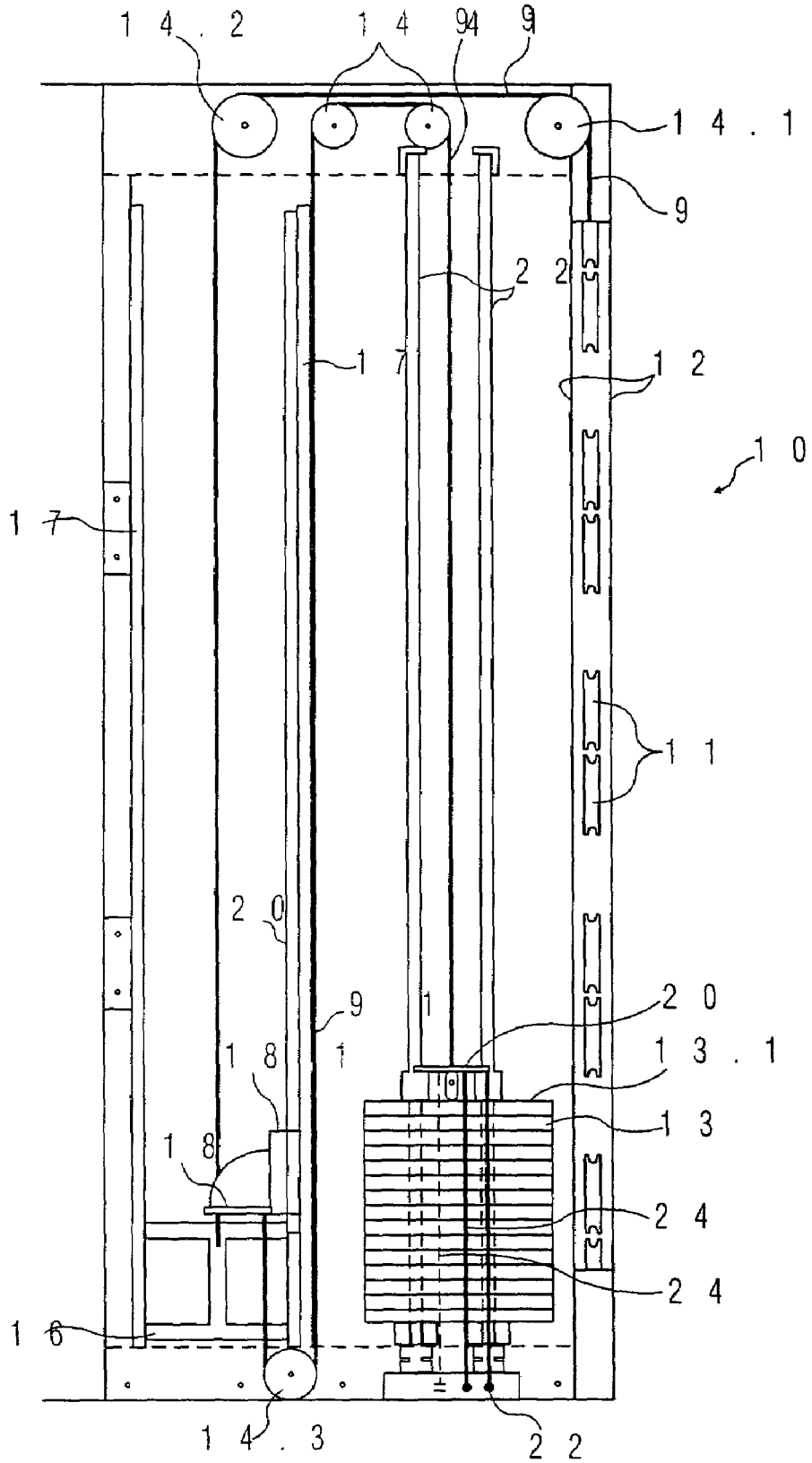
FIG. 8 is a cutaway view of the exercise equipment of FIG. 6 showing how a weight stack is attached to distal ends of a plurality of cables of the exercise equipment of FIG. 6, and showing a spring device mounted on both sides of the weight stack.

FIG. 8 is a cutaway front view of a portion of the exercise equipment in FIG. 6. FIG. 8 illustrates in more detail how one cable 9.1 is strung through the equipment 10. The cables 9 are horizontally redirected when they pass over pulleys 14.1 and then vertically downward as they pass over pulleys 14.2 where the distal ends of cables 9 are attached to counterweights 16. When the proximal end of a cable 9 is pulled, it raises the counterweights 16. A horizontal plate 18 with holes, slots or other openings cut so the cables 9 pass through the plate 18 is positioned above the counterweights 16 and extended over and attached or welded to a vertically positioned guiding means, e.g., a linear bearing 18.1 (or other guiding mechanism such as a roller system, or a bushing housed in a tube traveling on a rod, bar or other vertical support) traveling along a vertical shaft 20 positioned between a weight stack 13 and the counterweights 16. A single cable 9.1, which is attached to the underside of horizontal plate 18 and to a pulley 14.3 below, is then routed upward to two pulleys 14.4 above the weight stack and down to a plate 13.1 to guide the weights 13 vertically along two upright guide rods 22 extending downward through the weight stack 13. A rod extends downward through the center of the weight stack with holes cut in it to allow a selector pin to slide into the weight stack 13 so the user can select the desired weight to lift. When the user pulls on the proximal end of the cable 9, the counterweight 16 is lifted, thereby lifting the horizontal plate assembly 18 and, via the cable 9.1, the selected weights in the weight stack 13. Other cables 9 in the system that are not engaged by the user at that time are held in the ready position by their respective counterweights 16.

As may thus be seen in FIG. 8, the distal ends of the cables 9 are attached to the counterweights 16, which travel vertically through a slot mounted in a housing with each slot and counterweight 16 positioned side by side at the end of each respective cable 9, (one counterweight 16 for each cable 9 threaded through the system). The counterweights are positioned within the housing on the far side of the weights 13, but could be positioned in other arrangements relative to the weights. Optimal positioning is adjacent to the weights. The counterweights 16 are optimally also positioned at or slightly beneath the top plane of the weight stack 13, but could be positioned above the top plate 13.1.

Figure 7:
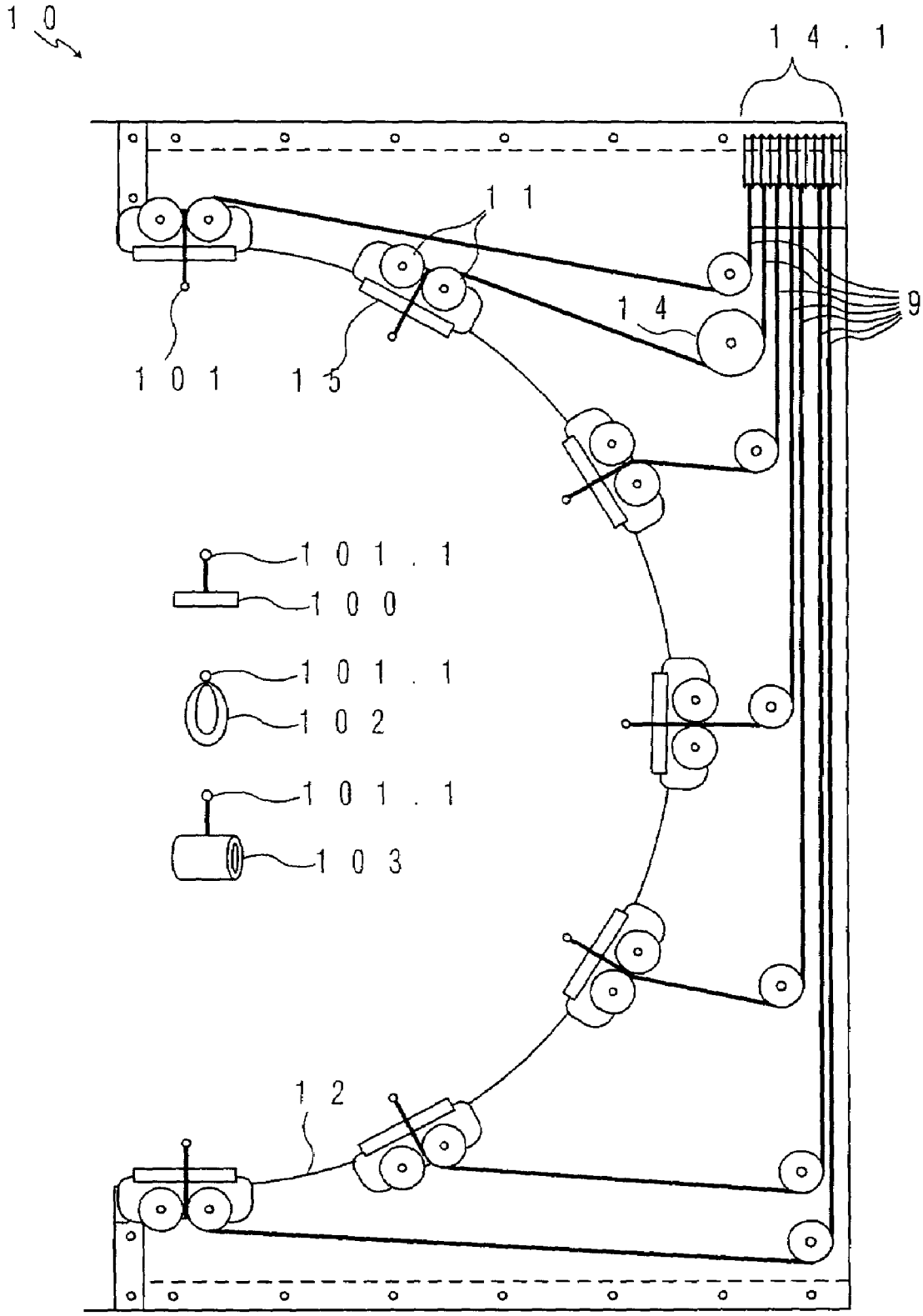
FIG. 7 is a cutaway view of the exercise equipment of FIG. 6 showing the arrangement of multiple cables.

Exercise equipment of the type shown in FIGS. 6-8 is disclosed in applicant's U.S. Pat. No. 6,705,976, the contents of which are incorporated herein by reference.

According to the present invention, a connector plate 20 is arranged on top of the weight stack and an eye hook or bracket 22 is attached to the bottom portion of the frame on both sides of the weight stack 13. Spring devices 24 and 24' are then connected between one end of the connector plate 20 and the eye hook 22 on each side of the weight stack.

Figure 9B:
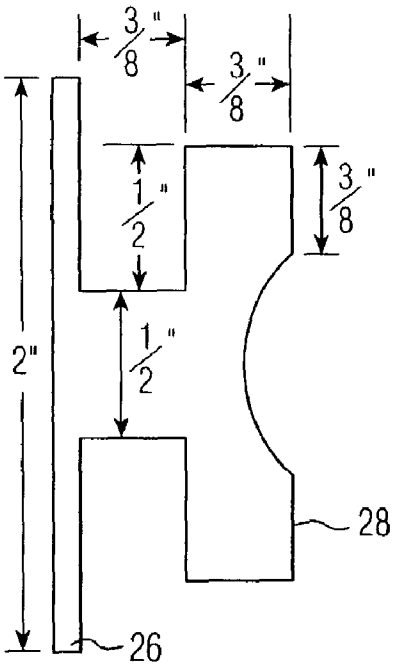
FIGS. 9A and 9B are side and end views, respectively, of an L-type bracket for holding one end of a rubber band which forms a spring device on one side of the weight stack in the exercise equipment of FIG. 6.
Figure 9A:
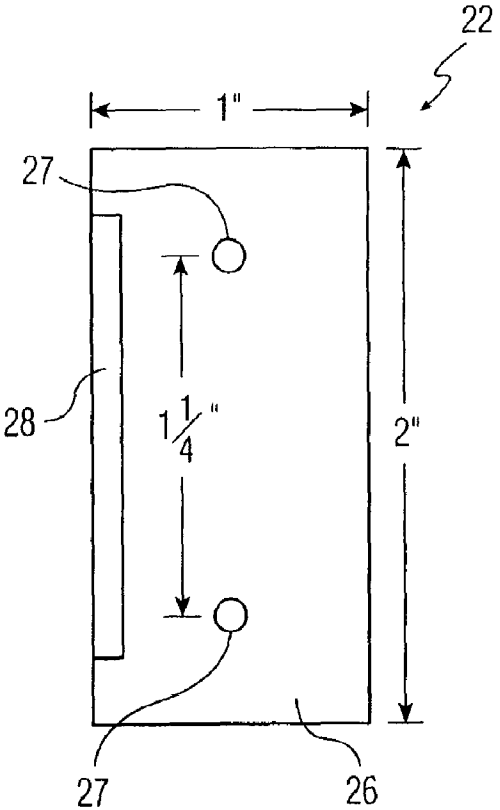

FIGS. 9A and 9B show in front view and side view, respectfully, an L-type bracket which may be used to connect one spring device (either 24 or 24') to the frame on one side of the weight stack. This bracket 22 has a base plate 26 with holes 27 for bolting to the frame and a bent over edge 28 which is cut away to form a hook for a spring device 24 or 24'.

Figure 10:
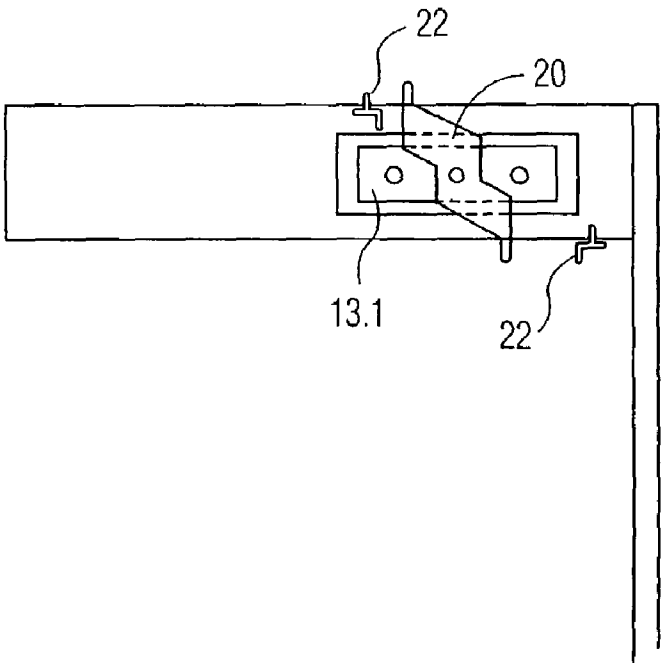
FIG. 10 is a top view showing a Z-shaped bracket, attached to the top of the weight stack in the exercise equipment of FIG. 6, for mounting a rubber band which forms a spring device on both sides of the weight stack.
Figure 11:
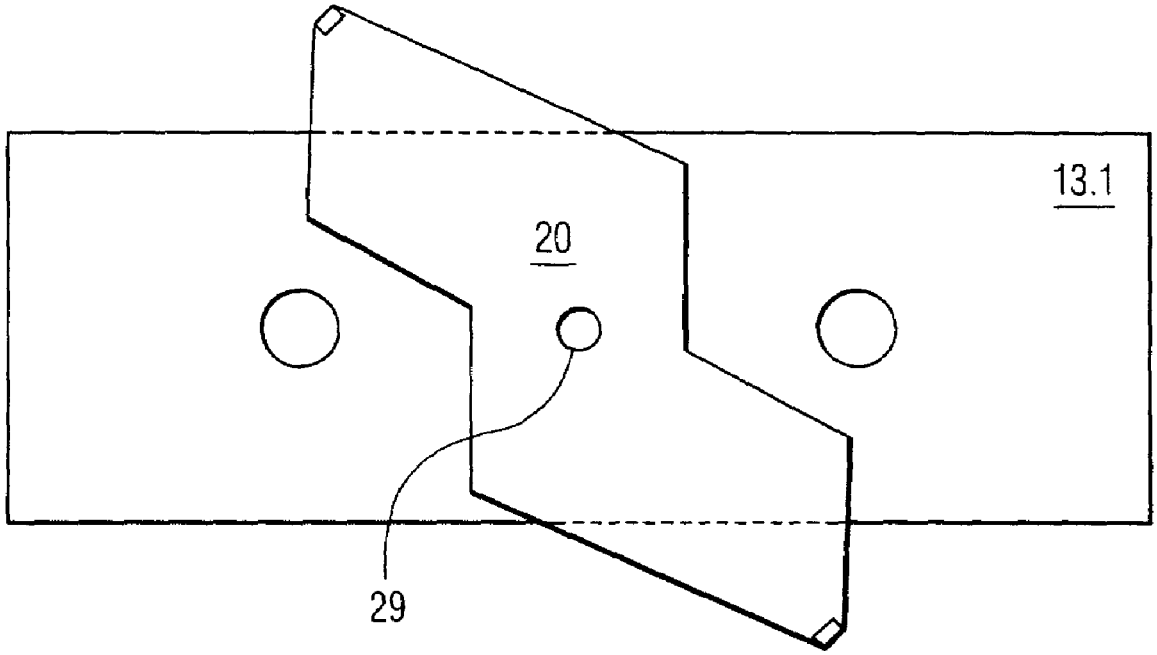
FIG. 11 is a detailed view of the Z-shaped bracket of FIG. 11.

FIGS. 10 and 11 show, in top view, the connector plate 20 which is stamped in a "Z" shape with its opposite corners bent over to form hooks for the two spring devices 24 and 24'. The connector plate 20 is placed directly over the top plate of the weight stack and has a hole 29 which allows the bolt stem at the end of the cable 9.1 to pass through it.

The spring devices 24 and 24', which are preferably heavy rubber bands, may thus be easily attached between the connector plate 20 and the brackets 22 on either side of the weight stack, when the user wishes to operate the exercise equipment in a high-speed training mode. For normal operation of the exercise equipment, the spring devices may be removed.

Figure 12:
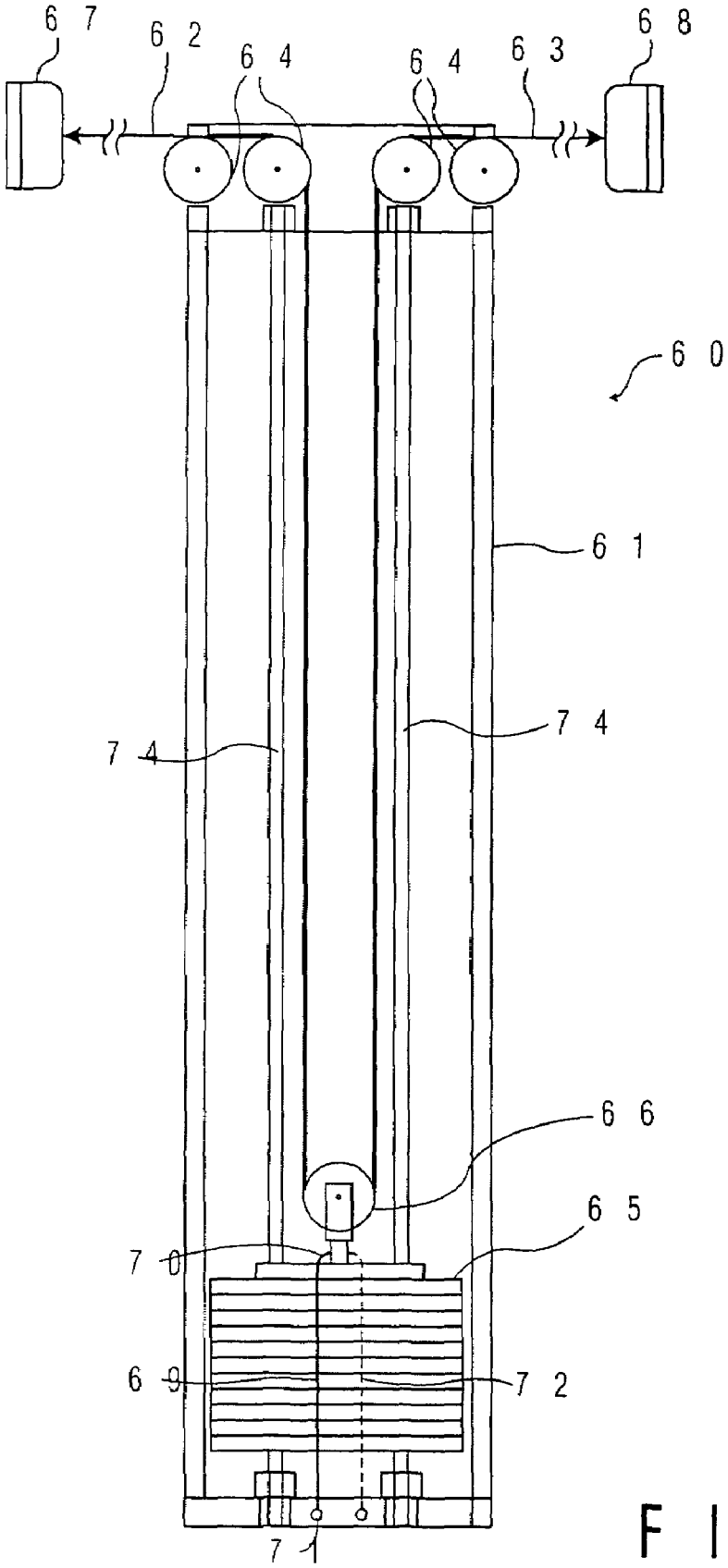
FIG. 12 is a representational diagram showing another type of exercise equipment in which handles are connected to opposite ends of a cable and both a weight stack and a spring device are connected to a pulley near the mid point of the cable.

FIG. 12 illustrates still another preferred embodiment of the present invention as it may be applied to the exercise apparatus disclosed in the copending U.S. patent application Ser. No. 09/965,032, which application is incorporated herein by reference. In this embodiment, the exercise equipment 60 has a frame 61 and either single or multiple cables 62 and 63 having two ends directed by pulleys 64 to handles 67 and 68, respectively. Using both handles 67 and 68 allows users more choices of positions when training on a single machine. The cable(s) 62 and 63 are directed downward by pulleys 64 and pass(es) around a pulley 66 which supports the weight stack 65.

With this arrangement, only one half of the total weight of the weight stack is lifted when one of the two handles 67 or 68 is pulled.

According to the invention, this exercise equipment may be used in high-speed training by attaching a spring device 69 between a point 70 at the top of the weight stack and a point 71 on the bottom portion of the frame. A second spring device 72 is also preferably attached on the opposite side of the weight stack so as to balance the forces applied to the weight stack and allow it to easily slide along the rods 74.

Figure 14:
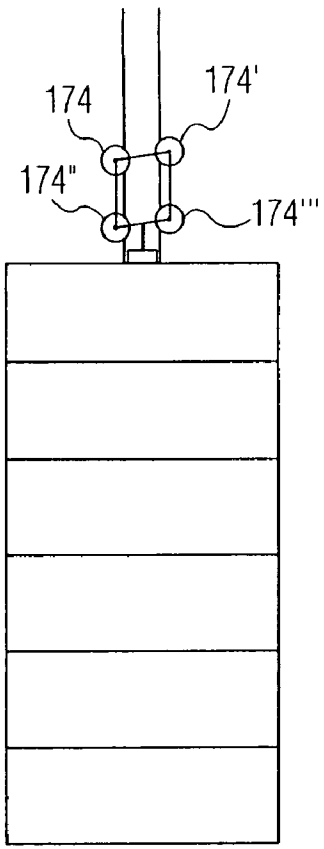
FIG. 14 is a side view, similar to FIG. 13*b*, showing a modified roller system according to the invention comprising four rollers.

FIGS. 13-15 illustrate alternative embodiments for reducing friction between the top most weight of the weight stack and the guide rods or rails which pass through the weights. With these embodiments, it is possible to connect one or more tension springs between the top most weight and the bottom frame of the exercise equipment, on only one side of the weight stack.

Figure 13C:
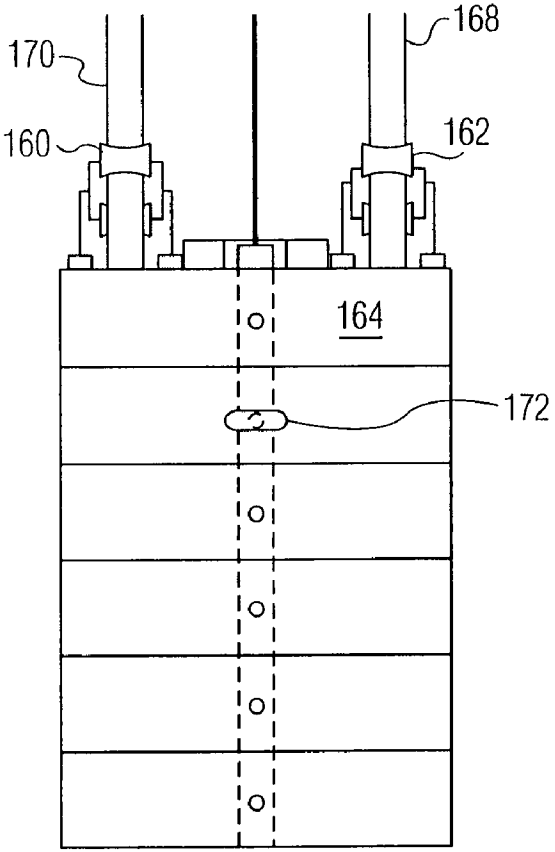
FIGS. 13*a*, 13*b* and 13*c* are a top view, side view and front view, respectively, of a roller system for stabilizing the top weight of a weight stack while minimizing friction between this weight and its associated guide rods.
Figure 13B:
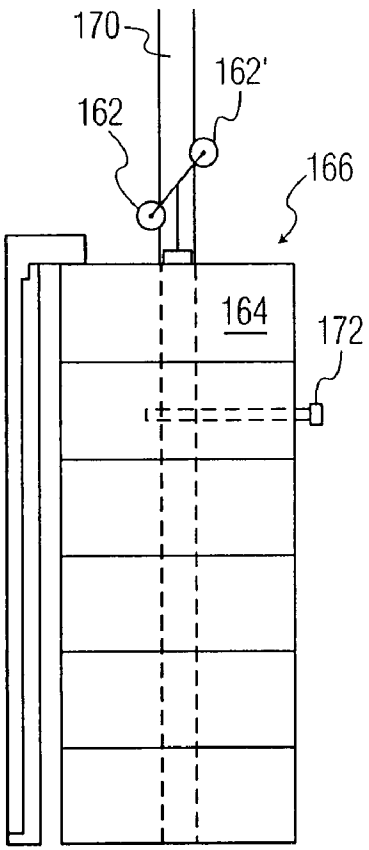
Figure 13A:
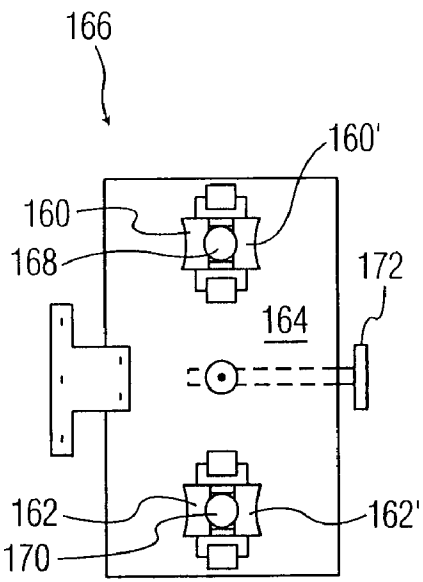

As shown in FIGS. 13*a*, 13*b* and 13*c*, a pair of rollers 160 and 160', and 162 and 162', are rotatably mounted above the top plate 164 of the weight stack 166 to minimize friction with guide rods 168 and 170 as the top weight 164 and any other weights connected thereto via the selector pin 172 move linearly up and down.

FIG. 14 shows a modification of the roller system comprising four rollers 174, 174', 174" and 174'" instead of each of the roller pairs 160, 160' and 162, 162'. These roller systems are designed to minimize friction between the weights of the weight stack and the respective guide rods.

Figure 15C:
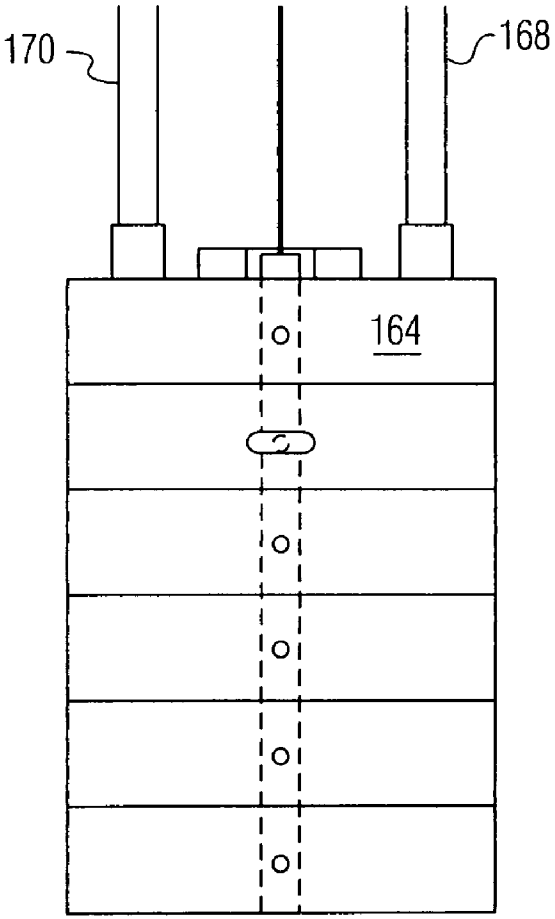
FIGS. 15*a*, 15*b* and 15*c* are a top view, side view and front view, respectively, of a weight stack having linear bearings for stabilizing the top weight and minimizing friction, with a spring device attached to only one side of the top weight.
Figure 15B:
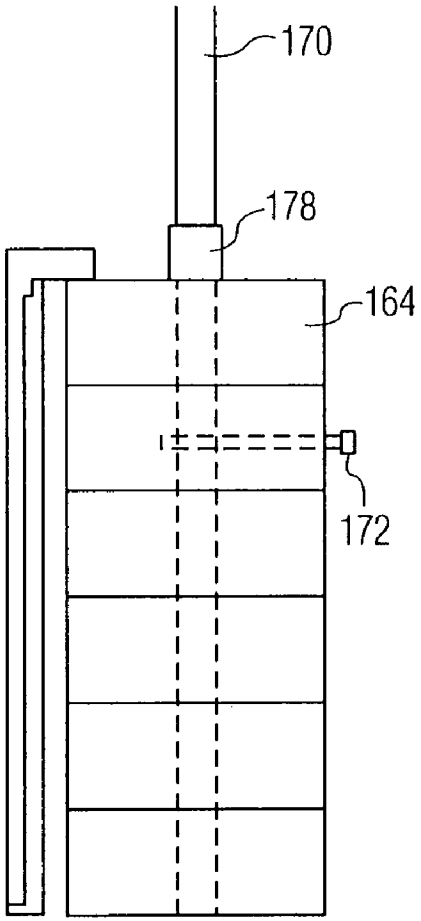
Figure 15A:
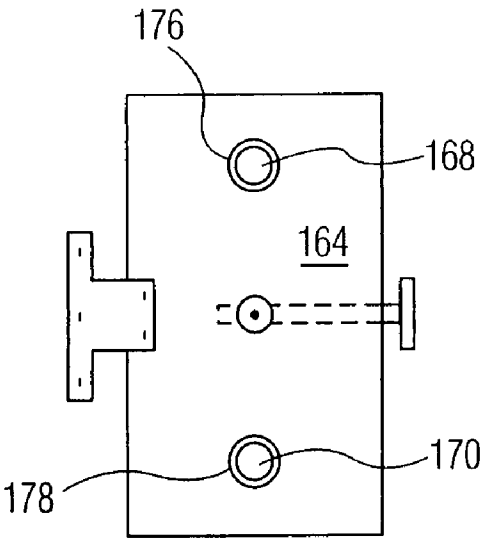

FIGS. 15*a*, 15*b* and 15*c* illustrate a modification of this embodiment for minimizing friction when a tension spring is applied to only one side of the weight stack. In this embodiment, linear bearings, preferably with Teflon or other friction-reducing bearing surfaces, are provided in place of the roller systems shown in FIGS. 13 and 14. The linear bearings 176 and 178 surround the guide rods 168 and 170, thereby reducing the friction between the top most weight 164 and the guide rods as it is caused to move up and down by the user of the exercise machine.

Alternatively, instead of applying tension springs on one side of the weight stack, it is possible to apply compression springs to the top most weight of the weight stack. In this case, the roller bearings or linear bearings may be retained so as to reduce friction when the spring force is applied unequally to the top most plate.

Finally, it should be noted that the spring device may be connected directly to the cable, the moving arm and/or the handle of the exercise apparatus, thus avoiding entirely the problem of friction of the top most weight with respect to the guide rods.

There has thus been shown and described novel exercise apparatus for high-speed training which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In exercise equipment comprising, in combination:

(a) a frame structure;

(b) at least one handle coupled to the frame structure and adapted for movement by a user in a first direction and in an opposite second direction;

(c) a weight stack comprising a plurality of individual weights that may be added and removed to adjust the gravitational force applied to the handle, said weight stack having two face sides;

(d) a device for removably holding at least one weight of said weight stack, said weight holding device being moveably arranged on at least one guide attached to the frame structure and being coupled to the handle, for applying a gravitational force to the handle in said second direction contrary to movement in said first direction, wherein said weight holding device is lifted upwards along said at least one guide when the handle is moved by a user in said first direction; and (e) at least one spring having two ends, said spring being coupled to one side of said weight holding device at one end and to the frame structure below the weight stack at the opposite end, for applying a downwardly acting spring force to the weight holding device in addition to the gravitational force applied thereto by said weight stack;

the improvement wherein said at least one spring includes friction reducing means, for minimizing friction between said weight holding device and said at least one guide when said weight holding device is moved with respect to said at least one guide, said friction reducing means including a first and a second spring of substantially equal spring tension, each spring disposed on an opposite side of said weight holding device and an opposite face side of the weight stack to balance the forces applied to said weight holding device, to thereby reduce the friction between said weight holding device and said at least one guide.

2. The exercise equipment recited in claim 1, wherein said at least one spring is removably coupled to said weight holding device and to said frame structure, such that one or more individual ones of the springs may be added and removed to adjust the spring force applied to the weight holding device.

3. The exercise equipment recited in claim 1, wherein said friction reducing means includes a friction-reducing bearing attached to said weight holding device and arranged to mechanically and rollingly couple said weight holding device to said at least one guide.

4. The exercise equipment recited in claim 3, wherein said friction-reducing bearing includes at least one roller pair, attached to said weight holding device and disposed for movement on opposite sides of said at least one guide.

5. The exercise equipment recited in claim 4, wherein said roller pair has four rollers, with two rollers arranged on each side of said at least one guide.

6. The exercise equipment recited in claim 3, wherein said friction-reducing bearing includes at least one linear bearing attached to said weight holding device and arranged for movement with respect to said at least one guide.

7. The exercise equipment recited in claim 1, wherein said at least one spring is a tension spring.

8. The exercise equipment recited in claim 7, wherein said at least one spring is an elastic band.

9. The exercise equipment received in claim 7, wherein said at least one spring is a coil spring.

10. The exercise equipment recited in claim 1, wherein said at least one spring is a compression spring.

11. The exercise equipment recited in claim 10, wherein said at least one spring is a coil spring.

12. The exercise equipment recited in claim 1, wherein said at least one spring is a pneumatic spring.

13. In exercise equipment comprising, in combination:

(a) a frame structure having at least one cable exit point;

(b) a cable having a proximal end and a distal end, the cable passing through said cable exit point with the proximal end of the cable being attached to a handle that enables a user to pull the cable in a first direction against a restraining force;

(c) a weight stack comprising a plurality of individual weights that may be added and removed to adjust the gravitational force applied to the cable, the weight stack having two opposite face sides;

(d) a device for removably holding at least one weight of said weight stack, said weight holding device being moveably arranged on at least one guide attached to the frame structure and being coupled to the distal end of the cable, for applying a tensile force to the cable such that, when the handle and the proximal end of the cable are pulled in the first direction by a user, said weight holding device is lifted upwards along said at least one guide; and (e) at least one spring, coupled at one end to said weight holding device and at an opposite end to the frame structure below the weight stack, for applying a downward spring force to said weight holding device such that, when the proximal end of the cable is rapidly pulled by the user in the first direction, and then suddenly allowed to move in a second, opposite direction due to gravity acting on said at least one weight, the tensile force on the cable exceeds a prescribed value which is sufficient to keep the cable taught;

the improvement wherein said at least one spring includes friction reducing means, for minimizing friction between said weight holding device and said at least one guide when said weight holding device is moved with respect to said at least one guide, said friction reducing means including a first and a second spring of substantially equal spring tension, each spring disposed on an opposite side of said weight holding device and an opposite face side of the weight stack to balance the forces applied to said weight holding device, to thereby reduce the friction between said weight holding device and said at least one guide.

14. The exercise equipment recited in claim 13, wherein said at least one spring is removably coupled to said weight holding device and to said frame structure, such that one or more individual springs may be added and removed to adjust the spring force applied to the weight holding device.

15. The exercise equipment recited in claim 13, wherein said friction reducing means includes friction-reducing bearing attached to said weight holding device and arranged to mechanically and rollingly couple said weight to said at least one guide.

16. The exercise equipment recited in claim 15, wherein said friction-reducing bearing includes at least one roller pair, attached to said weight holding device and disposed for movement on opposite sides of said at least one guide.

17. The exercise equipment recited in claim 16, wherein said roller pair has four rollers, with two rollers arranged on each side of said at least one guide.

18. The exercise equipment recited in claim 15, wherein said friction-reducing bearing includes at least one linear bearing attached to said weight holding device and arranged for movement with respect to said at least one guide.

19. The exercise equipment recited in claim 13, wherein said at least one spring is a tension spring.

20. The exercise equipment recited in claim 19, wherein said at least one spring is an elastic band.

21. The exercise equipment received in claim 19, wherein said at least one spring is a coil spring.

22. The exercise equipment recited in claim 13, wherein said at least one spring is a compression spring.

23. The exercise equipment recited in claim 22, wherein said at least one spring is a coil spring.

24. The exercise equipment recited in claim 13, wherein said at least one spring is a pneumatic spring.

25. The exercise equipment recited in claim 2, wherein individual ones of said springs have substantially the same spring constant.

26. The exercise equipment recited in claim 2, wherein individual ones of said springs have a different spring constant.

27. The exercise equipment recited in claim 14, wherein individual ones of said springs have substantially the same spring constant.

28. The exercise equipment recited in claim 14, wherein individual ones of said springs have a different spring constant.

* * * * *